United States Patent [19]

McLoughlin

[11] 3,968,824

[45] July 13, 1976

[54] PROTECTIVE COVER FOR EXTENDING SHAFTS

[76] Inventor: John McLoughlin, 92 Mobrey Lane, Smithtown, N.Y. 11787

[22] Filed: June 23, 1975

[21] Appl. No.: 589,245

[52] U.S. Cl. ..... 150/52 R

[51] Int. Cl.[2] ..... B65D 59/08

[58] Field of Search ..... 182/107, 108; 280/150 R, 150 B; 150/52 K, 52 R; 16/108

[56] References Cited

UNITED STATES PATENTS

| | | | |
|---|---|---|---|
| 1,238,901 | 9/1917 | Ferguson | 150/52 R X |
| 2,686,530 | 8/1954 | Dire | 150/52 R X |
| 2,904,128 | 9/1959 | Boham | 182/108 |
| 3,327,280 | 6/1967 | Levine | 150/52 R X |
| 3,557,853 | 1/1971 | Jones | 150/7 |
| 3,851,689 | 12/1974 | Kohls | 150/3 X |

*Primary Examiner*—Donald F. Norton
*Attorney, Agent, or Firm*—James P. Malone

[57] ABSTRACT

A protective cover for extending shafts. A padded cover or boot enclosure open at one end is fitted over the end of an extending shaft, such as a ladder on a fire truck. An adjustable mounting strap is fixedly connected to one side of the cover at one strap end and removably connected at the other strap end to the opposite side of the cover. A retaining strap with a hook type fastener is connected to the cover, and is also connected to a fixed object to prevent the cover from being lost when the cover is removed from the shaft.

2 Claims, 2 Drawing Figures

PROTECTIVE COVER FOR EXTENDING SHAFTS

This invention relates to protective covers for extending shafts.

One embodiment of the invention is to cover the projecting legs of ladders of fire trucks. When the firemen are running around the end of the truck, getting on, getting off, connecting hoses or removing or replacing equipment, there is the likelihood that one or more of the firemen will run into the projecting ends of the ladders and sustain injuries to the heads or faces, which result in lost time at a crucial stage of the fire fighting effort.

The present invention provides a protective cover for extending shafts comprising a padded enclosure which is open at one side and is adapted to fit over the end of the extending shaft. An adjustable mounting strap is fixedly connected to the enclosure at one end of the strap and is removably connected to the enclosure at the other end of the strap with a hook type fastener. A retaining strap is also connected to the enclosure connecting the enclosure to a fixed object on the truck to prevent the protective cover from being lost when it is removed from the shaft.

Accordingly, a principal object of the invention is to provide protective covers for extending shafts.

Another object of the invention is to provide protective covers for legs of ladders on fire trucks.

These and other objects of the invention will be apparent from the following Specification and drawings, of which:

Figure 2:
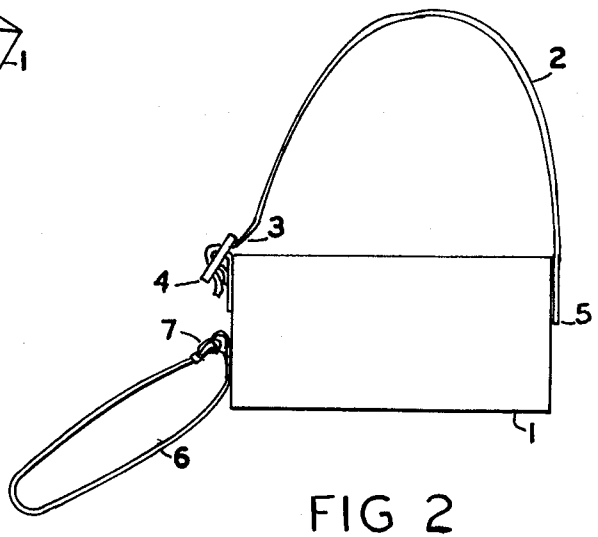
FIG. 2 is a side view of an embodiment of the invention.
Figure 1:
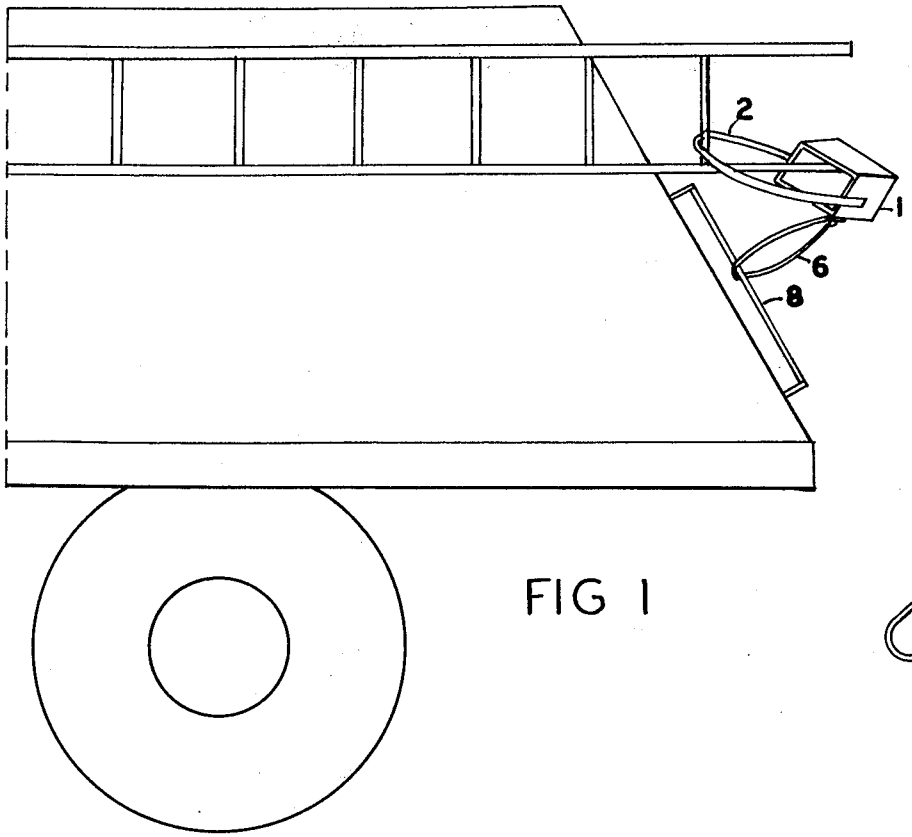
FIG. 1 is a perspective view of an embodiment of the invention showing the use thereof.

Referring to the drawings, the invention comprises a padded cover enclosure 1, having one open end. The protective cover enclosure may be made of canvas and stuffed with a pad, such as, foam rubber. An adjustable mounting strap 2 is adjustably connected to the cover at one end of the strap 3, by means of a buckle 4, which is mounted on one side of the cover. The strap 2, may be looped around a rung 10, of ladder 11. The other end of the strap 2 is removably connected to the cover by means of a hook type or Velcro fastener 5. The purpose of this connection is so that the cover can be disconnected instantaneously without fumbling with hooks, buckles or other fasteners.

A retaining strap 6 is fixedly connected to the cover and is adapted to be looped around some permanent part, for instance, a structural member 8, of the fire truck 9, so that when the cover is removed from the shaft it will not fall to the ground and be lost. The retaining strap is connected to the cover with a snap hook fastener 7.

The covers may be made in various sizes to fit particular extending members. The cover is preferably of a bright color, such as, yellow, in order to be easily visible. The padding is preferably about one inch thick and may be of foam rubber. The padding is installed in all sides and in the bottom of the cover between the inner and outer surface of the cover, which may be of canvas or equivalent plastic.

The device is used as follows:

1. Place cover over end of ladder leg.
2. With hook fastener engaged, adjust mounting strap buckle so it is a snug fit around nearest ladder rung.
3. Use the second strap to attach the cover to the apparatus. This will insure that the cover will not get lost when the cover is removed at a fire.

I claim:

1. A protective cover for extending shafts comprising;

an enclosure open at one end, said enclosure being padded and being adapted to fit over the end of an extending shaft, an adjustable mounting strap fixedly connected to one side of said enclosure at one strap end, means to removably connect the other strap end to the opposite side of said enclosure, and a retaining strap connected to said enclosure, said retaining strap being adapted to be connected to a fixed object to prevent said enclosure from being lost when said enclosure is removed from said shaft.

2. Apparatus as in claim 1 wherein said means to removably connect said strap to said enclosure is a quickly removable hook type fastener.

* * * * *